US005522300A

United States Patent [19]

Cheatwood

[11] Patent Number: 5,522,300

[45] Date of Patent: Jun. 4, 1996

[54] DRUMSTICK STATION

[76] Inventor: Mark W. Cheatwood, P.O. Box 913, Myrtle Beach, S.C. 29578

[21] Appl. No.: 315,830

[22] Filed: Sep. 30, 1994

[51] Int. Cl.[6] ..... G10D 13/02; A45C 11/00; B65D 85/20; A47F 1/04

[52] U.S. Cl. ..... 84/453; 84/421; 248/411; 248/188.5; 206/314; 206/443; 211/60.1

[58] Field of Search ..... 84/453, 421; 211/60.1, 211/70; 206/314, 443; 248/411, 188.5, 186, 178

[56] References Cited

U.S. PATENT DOCUMENTS

| | | | |
|---|---|---|---|
| D. 265,877 | 8/1982 | Hardy | D17/22 |
| 432,305 | 7/1890 | Foley | 84/329 |
| 537,771 | 4/1895 | Hirsch | 211/60.1 |
| 566,330 | 8/1896 | Marsden | 211/60.1 |
| 1,491,926 | 4/1924 | Rosenwald | 211/60.1 |
| 2,929,510 | 3/1960 | Penn | 211/60.1 |
| 2,968,406 | 1/1961 | Balfour | 211/60.1 |
| 3,768,202 | 10/1973 | Wheelok | 211/60.1 |
| 3,926,393 | 12/1975 | Tainsh | 211/60.1 |
| 4,531,443 | 7/1985 | Gillis, Jr. | 211/111 |
| 4,947,998 | 8/1990 | Smeller | 211/70.6 |
| 4,987,817 | 1/1991 | Diaz | 84/421 |
| 5,011,028 | 4/1991 | Sweeney | 211/60.1 |
| 5,092,463 | 3/1992 | Dees | 211/70.6 |
| 5,117,724 | 6/1992 | Gardner | 206/314 |

*Primary Examiner*—Cassandra C. Spyrou
*Attorney, Agent, or Firm*—Michael E. Mauney

[57] ABSTRACT

A drumstick station for holding drumsticks to be readily accessible to a drummer during a performance. The drumstick station has a stick holder which is adjustably mounted to a plurality of telescoping rods which may be mounted on a tripod base or on a drum itself. The telescoping rods allow a vertical adjustment in the height of the stick holder. The adjustable mounting of the stick holder to the telescoping rods allows the stick holder to be adjusted in two planes in addition to the vertical adjustment allowed by the telescoping rods. A variety of configurations within the stick holder allow a wide choice for a drummer in determining how the sticks are held within the drumstick station.

12 Claims, 3 Drawing Sheets

DRUMSTICK STATION

FIELD AND BACKGROUND OF THE INVENTION

This invention relates to Drumstick organizing apparatus, and more particularly to a station which allows organization of drumsticks in a convenient and readily accessible location.

In a popular music band, a drummer plays an important part in the overall sound of the band. Usually, a drummer is called upon to play a variety of percussion instruments. These instruments or drums are usually arranged around the drummer's seat. They are arranged in this fashion so that the drummer can quickly move from one percussive instrument to the other, depending on the demand of the song being played. These instruments can range from kettle drums, snare drums, and the like to bells and cymbals. The common thread for playing each of these instruments is the use of a drumstick which is used to strike, hence, percuss the instruments to produce the desired sound. Each instrument may have its own characteristic drumstick, and some drums require more than one type of stick to produce different sounds. Further, during the course of the performance it is a frequent occurrence that the drummer may drop one of the sticks or the stick may even break. Accordingly, it is necessary for the drummer to have immediately available a variety of types of drumsticks in an easily accessible fashion.

One common way drummers have of organizing their sticks and making them readily available, is through what is referred to as a stick bag. This stick bag is usually a fabric construction which has a number of pockets which allow the various types of drumsticks to be organized, one type for each pocket. Because the pouch is usually constructed of fabric, it is readily foldable and is used not only for organizing the drumsticks, but also for transportation. The stick bag may be unfolded and placed in proximity to the drummer during performance, sometimes being hung from the side of the drum or the framework of the drum. An improvement of the conventional stick bag is found in Gardner, U.S. Pat. No. 5,117,724. Gardner provided a stick bag modified to become a stool cover so that the stick bag would fit over the drummer's stool. The pockets in the Gardner stick bag had platforms within them so as to make pre-selected drumsticks more readily accessible by having them stick out above the remaining drumsticks that are held within that particular pocket.

Another way of organizing drumsticks has been to use trays, which have individual compartments which allow the drummer to organize his sticks with like sticks being placed within each compartment of the tray. A modification of the drumstick tray is found in Gillis, U.S. Pat. No. 4,531,443 which discloses a percussion stick holder consisting of two or more tubes which are fixed together in a parallel, spaced apart, relationship and are attached to the drum stand or other instrument stand by means of a gripper. The tubes in the Gillis device are used to hold individual drumsticks. The tubes are spaced apart so as to make each drumstick held within each tube readily distinguishable from its neighbor held in an adjoining tube, thus, making it easy to individually grasp each drumstick held within each tube.

None of the foregoing, however, meet the complex demands placed on a percussive instrument player or drummer in a modern popular music band. The tempo or beat of the music may be extremely fast. A variety of drums are played sometimes in alternate or quickly successive fashion and the demands of the music make it necessary to have the drumsticks immediately available requiring a minimum of movement both from the hands and the eyes of the drummer from the percussive instrument at hand. Accordingly, it would be a significant advancement in the art to provide a separate drumstick station, which can be adjusted to the height and angle demanded by an individual drummer which is most suitable and convenient for his or her physical size and style of playing, so that the drumstick station will be at a level most convenient for viewing and for grasping drumsticks held within the station. Accordingly, it is an advantage to provide a holder of sufficient size to hold a variety of drumsticks or other devices used to percuss the drum or other percussive instrument. The drummer knowing that all of his needed sticks are at one location need not go through the cognitive process of trying to remember where a particular type of drumstick or other percussive device is stored. Additionally, it is a feature of this current invention to provide a telescoping support rod for the holder, which may be either supported by a free-standing base or may be attached to one of the legs of the drums or other percussive instruments which are being played. The telescoping feature of the support rod allows it to be adjusted by the individual drummer to a height most convenient for that drummer, both in terms of his line of sight and of his reach. Additionally, the holder may be attached to the support rod in a rotatable adjustable fashion, so as to allow the holder to be oriented at such an angle as to be most convenient for the drummer who is using the drumstick station. These and other features and objects of this invention will become more readily apparent from the following description in conjunction with the accompanying drawings and claims.

DETAILED DESCRIPTION OF THE DRAWINGS

Figures 1, 1A:
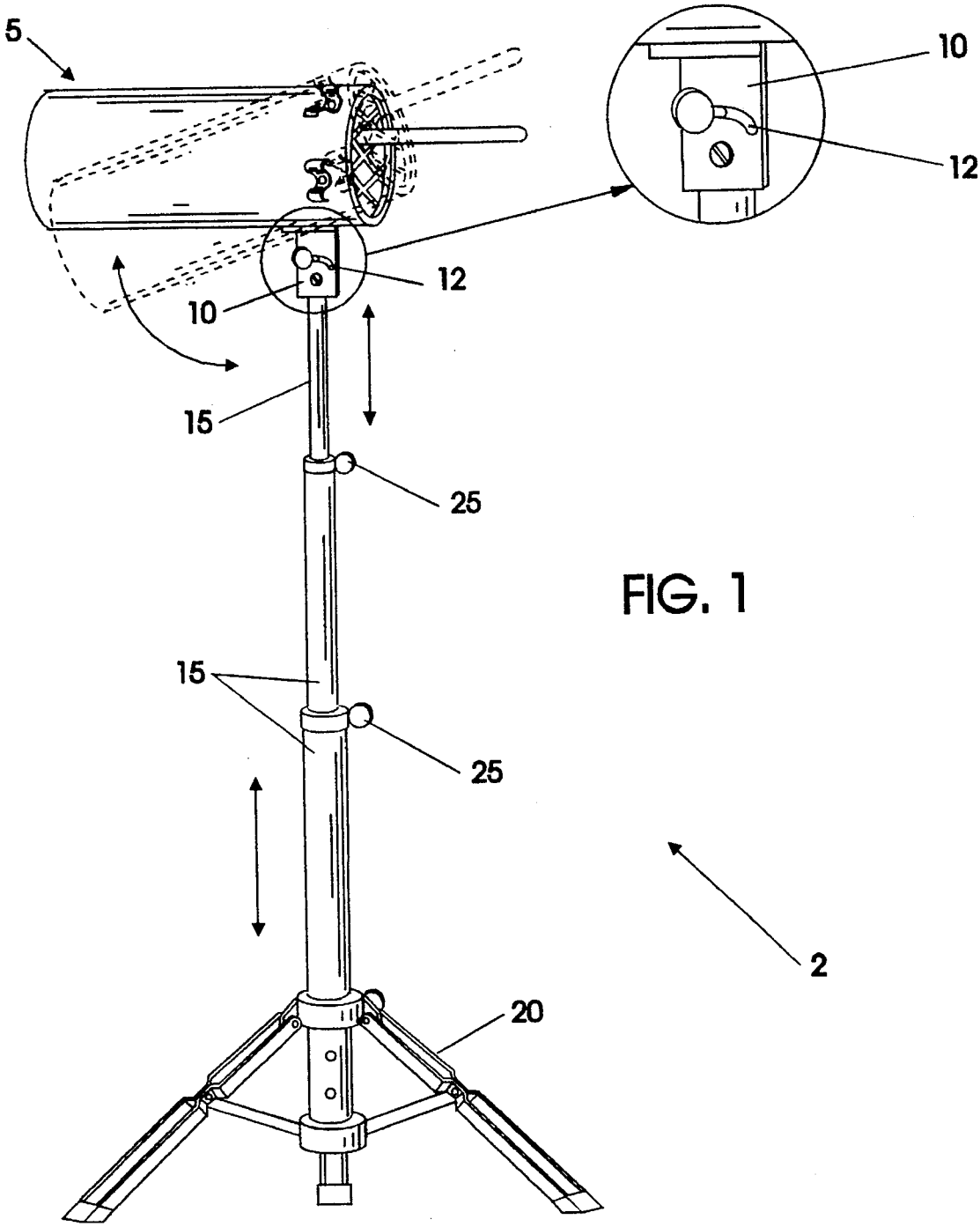
FIG. 1 shows the drumstick mounted on a tripod base and FIG. 1*a* shows in detail the mounting of the drumstick holder to telescoping rods.

FIG. 1 shows the drumstick station 2 for holding drumsticks (e.g. a drumstick holder). The drumstick station consists of a drumstick holder 5 mounted to a plurality of telescoping rods 15 supported by a tripod base 20. The drumstick holder 5 is mounted to a telescoping rod 15 by a mounting connection 10. The drumstick station 2 adjusts in several dimensions to meet the needs of a drummer. The drumstick station 2 adjusts in a vertical dimension by using a plurality of telescoping rods 15. The telescoping rods 15 are cylinders having different lengthwise dimensions and different circumferences. They are designed so that the inside circumference of one of the telescoping rods is slightly larger than the outside circumference of another rod so that one rod will easily fit and slide within another unless held in place by means of a wing nut 25 or some similar fastening device. The rod with the largest lengthwise dimension and circumference ordinarily serves as the base rod which is attached to a tripod base 20. It has been found that a lengthwise dimension of 22 inches (55.88 centimeters) and an outside circumference of 2.36 inches (6 centimeters) are appropriate dimensions for the base rod. A second telescoping rod nests within the first or base telescoping rod. It has been found that a lengthwise dimension of 18 inches (45.72 centimeters) and an outside circumference of 1.97 inches (5 centimeters) are appropriate dimensions for this second rod. The third telescoping rod nests within the second telescoping rod. It has been found that a lengthwise dimension of 12 inches (30.48 centimeters) and an outside circumference of 1.57 inches (4 centimeters) are appropriate dimensions. The base rod is attached to a tripod base 20. The second rod slides within the base rod and the third rod slides within the second rod. The stick holder 5 is attached by a mounting connection 10 to the third rod. Wing nuts are fitted at the upper end of the base rod, the telescoping rod with the largest dimensions, and the second rod (the telescoping rod with the next largest dimensions). If tightened the wing nuts hold the second rod in place inside the base rod and the third rod inside the second rod. If loosened, they allow the rod with the smaller circumference to slide within the rod with the larger circumference. This is indicated by the vertical arrows in FIG. 1. When a satisfactory vertical height for the stick holder 5 is found, the wing nuts are tightened which sets the stick holder at this desired vertical height. Because the third rod fits loosely inside the second rod, the third rod may be rotated. Rotation of this rod causes rotation of the drumstick holder 5. Therefore, the drumstick holder 5 is adjustable in a plane perpendicular to the plane of the vertical adjustment of the telescoping rods.

The mounting connection 10 has an arcuate slot 12. The mounting connection 10 is shown in detail in FIG. 1. The drumstick holder 5 may be moved within this arcuate slot 12. This motion allows the adjustment as is seen in the shadow lines in FIG. 1. Thus the drumstick holder 5 and a drumstick held within the drumstick holder 5 may be perpendicular to the telescoping rods 15 as is shown in the solid lines in FIG. 1, or they may be at an angle as is shown in the broken lines. Again, a wing nut or some other suitable bolt arrangement can be used to tighten the stick holder to the fixed orientation preferred by the drummer.

Figure 2A:
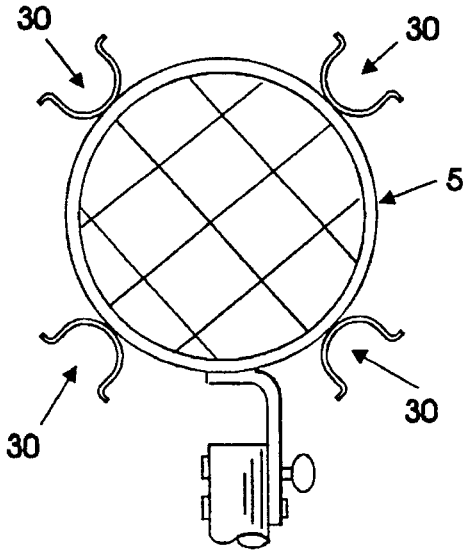
FIGS. 2*a*, 2*b*, 2*c*, and 2*d* show a variety of drumstick holders which are used with the drumstick station.

FIGS. 2*a, b, c* and *d* show a variety of drumstick holders 5. It is believed that drummers have widely varying preferences and that the drumstick holder 5 should be available in a variety of formats to meet any individual preference of a drummer.

FIG. 2*a* shows a cylindrical drumstick holder 5. Arranged on the outside of the drumstick holder are a variety of u-clips 30 within which an individual drumstick may be removably affixed. Inside the cylinder a grid is placed which runs along the length of the cylinder. One or more drumsticks may be placed within each compartment of the grid. These drumsticks will be loosely held in place by gravity. Most drumsticks are approximately 15 to 17 inches (38.10 to 43.18 centimeters) in length. The cylinder of the drumstick holder 5 should be approximately 10 inches (25.4 centimeters) in length. The drumstick holder 5 is closed on one end so that the drumstick may be inserted into the drumstick holder, resting on the supporting grid, where it is held in place by the closed end of the cylinder.

Figure 2B:
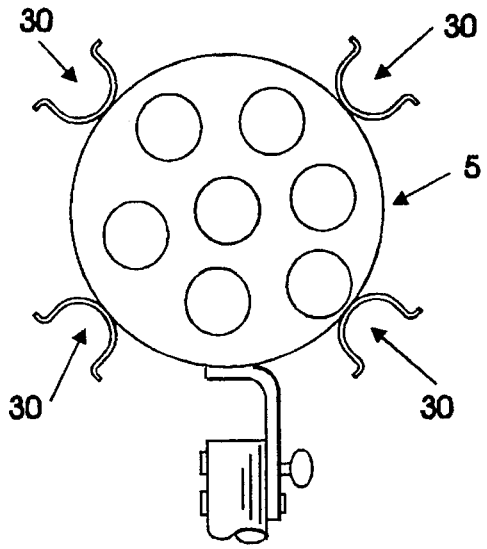

FIG. 2*b* shows an alternate construction for the drumstick holder 5 and more particularly for the interior of the cylinder of the drumstick holder 5. Here the interior is filled with an elastic foam which have holes cut of a suitable size so that a drumstick may be inserted within each hole and held in place not only by the force of gravity but also by the frictional force created by the soft sides of the foam. This arrangement will be preferred by drummers who prefer their sticks to be held more securely than can be achieved in the previously described grid interior for the cylinder of the drumstick holder 5.

Figure 2C:
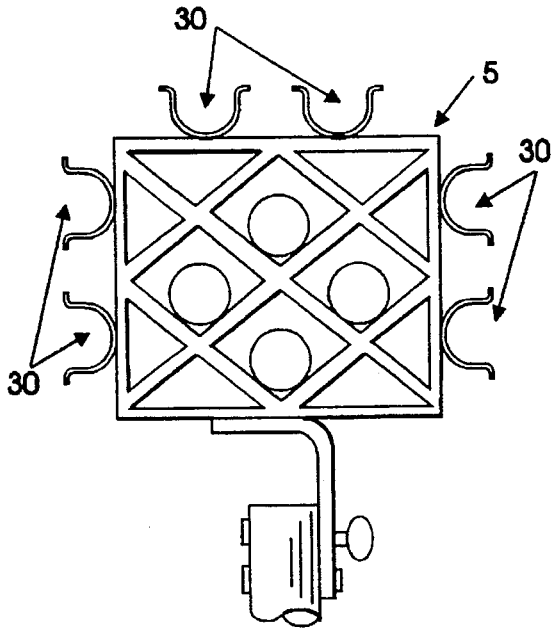
Figure 2D:
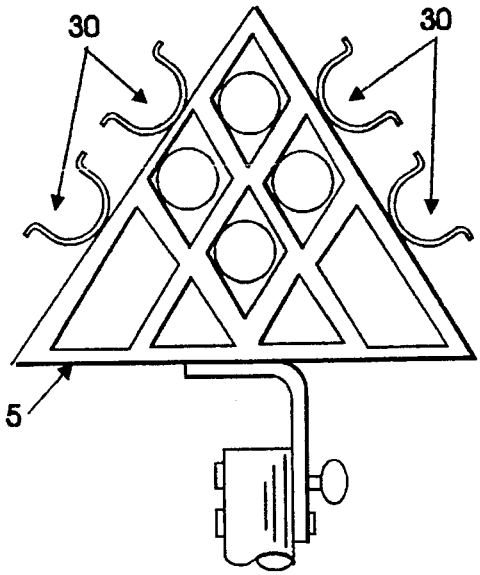

FIGS. 2*c* and 2*d* show different shapes for the drumstick holder 5, with 2*c* being a square drumstick holder and 2*d* being a triangular drumstick holder. Again the interior of 2*c* and 2*d* has a grid arrangement for holding individual sticks and u-clips 30 are arranged on the outside of the drumstick holder where other drumsticks may be secured by means of these u-clips 30.

Figure 3A:
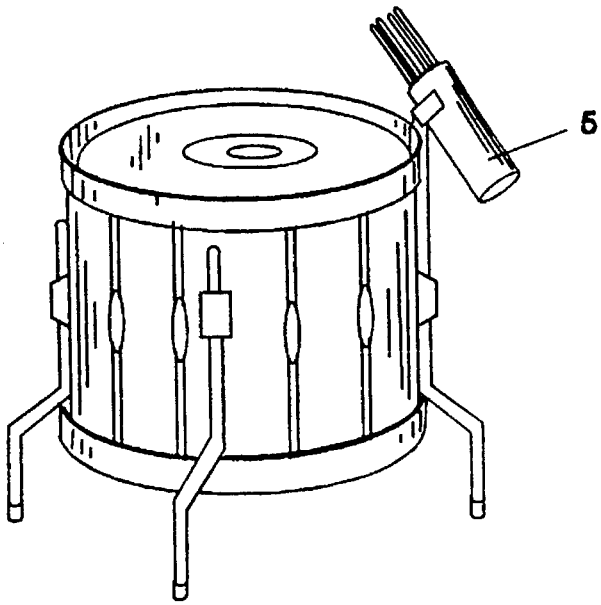
FIGS. 3*a* and 3*b* show the drumstick station mounted directly to different drums.

FIG. 3 shows the stick station as it might be mounted on a percussion instrument itself. For example, in FIG. 3*a* the drumstick holder 5 is shown mounted on a floor tom tom drum. Most floor tom tom drums are mounted on three legs although occasionally four legs are seen. The leg sizes are standard and the third telescoping rod on which the drumstick holder is affixed is designed so that its interior dimension will allow it to be placed over the floor tom tom drum leg and to be held in place by gravity. In addition a hole may be drilled within the third telescoping rod so that a wing nut or the like could be mounted and screwed to provide a more secure mounting by a frictional fit against the leg of the floor tom tom drum than is achieved by gravity alone.

Figure 3B:
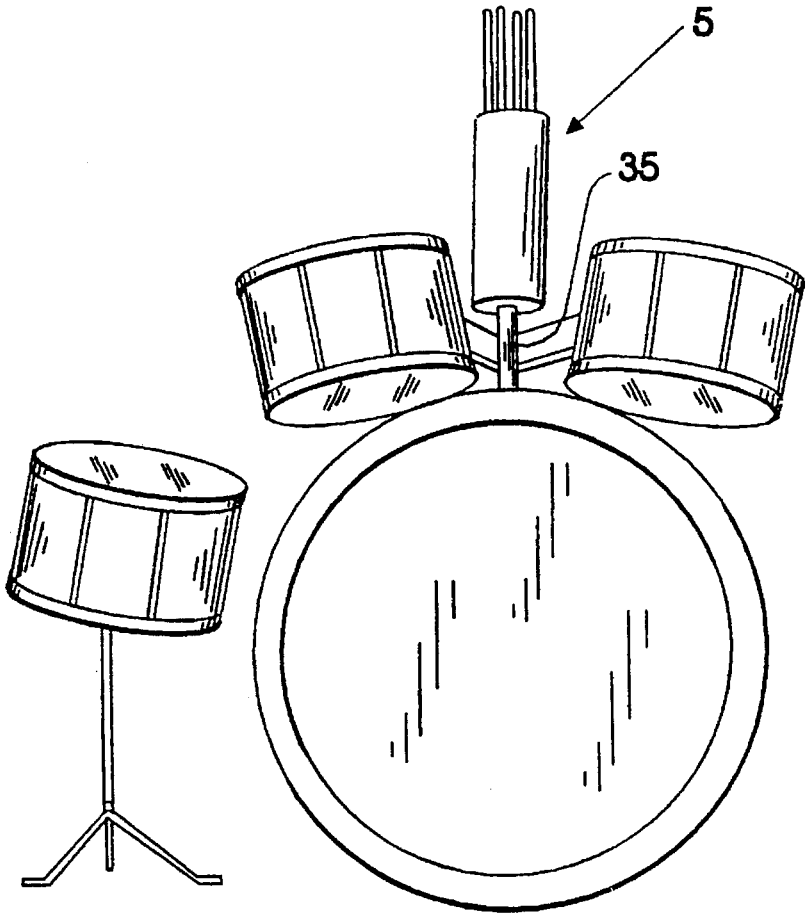

FIG. 3*b* shows the drumstick station mounted to a bass drum. Almost all bass drums come equipped with means for mounting a cymbal stand. The cymbal stand mounting 35 can be adopted to be used to hold the drumstick station in place. Again, the telescoping rod on which the stick holder is mounted is of a size that will accommodate itself to the cymbal stand mounting 35 which is found on most bass drums.

Other modifications of a similar nature are believed to be possible, and no limitation is intended on the invention by reason of these descriptions except as is set forth in the appended claims.

I claim:

1. An adjustable drumstick holder for a plurality of drumsticks comprising:

a housing with an open end, a closed end, and a grid extending lengthwise within the interior of said housing for receipt of a plurality of drumsticks and affixed to said housing on the exterior of said housing is at least one U-shaped clip for receipt of a drumstick;

a plurality of telescoping hollow cylinders;

means for adjustably mounting said housing to at least one of said hollow cylinders;

and means for supporting at least one of said hollow cylinders in a vertical plane.

2. An adjustable drumstick holder for a plurality of drumsticks as recited in claim 1 wherein said plurality of said telescoping hollow cylinders comprises three telescoping hollow cylinders adapted so that a first hollow cylinder is larger than a second hollow cylinder and a third hollow cylinder, said second hollow cylinder is somewhat smaller than said first hollow cylinder so that said second hollow cylinder nests within said first hollow cylinder, and said third hollow cylinder somewhat smaller than said second hollow cylinder so that said third hollow cylinder nests within said second hollow cylinder.

3. An adjustable drumstick holder for a plurality of drumsticks as recited in claim 2 wherein said means for adjustably mounting said housing to one of said hollow cylinders includes an arcuate slot whereby said housing adjusts to a desirable angle at a point along said arcuate slot and is tightened into place at said point.

4. An adjustable drumstick holder for a plurality of drumsticks as recited in claim 3 wherein said means for supporting said hollow cylinders in a vertical plane is a tripod base affixed to said first hollow cylinder.

5. An adjustable drumstick holder for a plurality of drumsticks as recited in claim 3 wherein at least one of said hollow cylinders is sized so as to mount on a cymbal stand holder.

6. An adjustable drumstick holder for a plurality of drumsticks as recited in claim 3 wherein at least one of said hollow cylinders is sized so as to mount on a leg of a floor tom tom drum.

7. An adjustable drumstick holder for a plurality of drumsticks comprising:

a housing with an open end, a closed end and a foam lining within the interior of said housing with said foam lining having a plurality of holes wherein each of said holes is adapted for receipt of at least one drumstick and affixed to said housing or the exterior of said housing is at least one U-shaped clip for receipt of a drumstick;

a plurality of telescoping hollow cylinders;

means for adjustably mounting said housing to at least one of said hollow cylinders;

and means for supporting at least one of said hollow cylinders in a vertical plane.

8. An adjustable drumstick holder for a plurality of drumsticks as recited in claim 7 wherein said plurality of said telescoping hollow cylinders comprises three telescoping hollow cylinders adapted so that a first hollow cylinder is larger than a second hollow cylinder and a third hollow cylinder, said second hollow cylinder is somewhat smaller than said first hollow cylinder so that said second hollow cylinder nests within said first hollow cylinder, and said third hollow cylinder somewhat smaller than said second hollow cylinder so that said third hollow cylinder nests within said second hollow cylinder.

9. An adjustable drumstick holder for a plurality of drumsticks as recited in claim 8 wherein said means for adjustably mounting said housing to one of said hollow cylinders includes an arcuate slot whereby said housing adjusts to a desirable angle at a point along said arcuate slot and is tightened into place at said point.

10. An adjustable drumstick holder for a plurality of drumsticks as recited in claim 9 wherein said means for supporting said hollow cylinders in a vertical plane is a tripod base affixed to said first hollow cylinder.

11. An adjustable drumstick holder for a plurality of drumsticks as recited in claim 9 wherein at least one of said hollow cylinders is sized so as to mount on a cymbal stand holder.

12. An adjustable drumstick holder for a plurality of drumsticks as recited in claim 9 wherein at least one of said hollow cylinders is sized so as to mount on a leg of a floor tom tom drum.

* * * * *